US007401899B2

(12) United States Patent
Nellen

(10) Patent No.: US 7,401,899 B2
(45) Date of Patent: Jul. 22, 2008

(54) PRINTER WITH A DETACHABLE PRINTHEAD

(75) Inventor: Wilhelmus H. J. Nellen, Venlo (NL)

(73) Assignee: Oce-Technologies B. V., Venlo (NL)

( * ) Notice: Subject to any disclaimer, the term of this patent is extended or adjusted under 35 U.S.C. 154(b) by 386 days.

(21) Appl. No.: 11/318,565

(22) Filed: Dec. 28, 2005

(65) Prior Publication Data

US 2006/0139405 A1 Jun. 29, 2006

(30) Foreign Application Priority Data

Dec. 29, 2004 (EP) ..... 04107045

(51) Int. Cl.
*B41J 2/14* (2006.01)
*B41J 2/175* (2006.01)

(52) U.S. Cl. ..... 347/49; 347/86

(58) Field of Classification Search ..... 347/37, 347/49, 86

See application file for complete search history.

(56) References Cited

U.S. PATENT DOCUMENTS 4,736,213 A 4/1988 Piatt et al.
5,212,502 A 5/1993 Bowling
5,317,339 A 5/1994 Braun et al.
6,290,346 B1 * 9/2001 Santhanam et al. ..... 347/86
6,729,714 B2 * 5/2004 Sturgeon et al. ..... 347/49

FOREIGN PATENT DOCUMENTS

EP 0 791 461 A2 8/1997

* cited by examiner

*Primary Examiner*—An H Do
(74) *Attorney, Agent, or Firm*—Birch, Stewart, Kolasch & Birch, LLP

(57) ABSTRACT

A printer containing a printhead that is detachably mounted on a support plate and is held thereon at two rigid support points located on a first side of the printhead and one elastic support point located on a second side of the printhead opposite to said first side, each of the support points being defined by a first portion on the side of the printhead and a second portion on the side of the support plate, and one of the first and second portions is a spherical surface engaged in a recess of the other of the first and second portions in a self-centering manner wherein the second part of the elastic support point has its spherical surface formed by a bead or ball fixed on a wire, said wire being elastically biased toward the recess, so that the elastic support point releasably biases the printhead towards said first side of the printhead and released by lifting the wire, for detaching the printhead.

17 Claims, 4 Drawing Sheets

PRINTER WITH A DETACHABLE PRINTHEAD

This application claims priority to European Patent Application No. 04107045.9 filed on Dec. 29, 2004 in Europe, the entire contents of which is hereby incorporated by reference in its entirety.

BACKGROUND OF THE INVENTION

The present invention relates to a printer having a printhead which is detachably mounted on a support plate and is held thereon at two rigid support points located on a first side of the printhead, and one elastic support point located on a second side of the printhead, opposite to said first side, wherein each of the support points is formed by a first portion on the side of the printhead and a second portion on the side of the support plate, and one of the first and second portions is a spherical surface engaged in a recess of the other of the first and second portions in a self-centering manner.

The present invention is applicable to a scanning-type printer, e.g. an ink jet printer, wherein the support plate is provided on a carriage so that it may scan a recording medium in a main scanning direction, while the printhead faces the recording medium and prints individual pixels or sets of pixels. In order to obtain a high print quality, it is essential, that the printhead is stably positioned on the support plate with very high accuracy in all six degrees of freedom of the printhead. The accuracy requirements increase with increasing resolution of the printer and may, for example, only allow tolerances of up to ±3 mm.

In an ink jet printer, for example, the printhead typically has a plurality of nozzles that are arranged in a linear array forming an angle of exactly or approximately 90° with respect to the main scanning direction. The angle between the nozzle array and the main scanning direction must be defined with high precision. Frequently, the printer has a plurality of printheads mounted on the same support plate, e.g. printheads for different colors in case of a color printer. Thus, the angular positions of the nozzle arrays must be exactly the same for all printheads. Likewise, the printheads must be arranged with well defined spacings in the main scanning direction and must also be exactly aligned in that direction. Since a small gap is formed between the nozzle surface of the printhead and the surface of the recording medium, the ink droplets expelled from the nozzles must fly a certain distance through the air before they hit the recording medium. Since the carriage is moving, the flight distance of the ink droplets has an influence on the positions of the pixels formed on the recording medium, and, as a consequence, the gap between the printheads and the recording medium must also be defined with high accuracy.

In a conventional printer, the position and posture of the printhead in all six degrees of freedom is defined by six contact surfaces where the printhead engages the support plate, and a spring assembly is used for biasing the printhead against each contact surface. However, if, for any reason, an external force tends to deviate the printhead from the intended position, frictional forces at the contact surfaces may prevent the printhead from returning exactly to its original position. Moreover, if the printhead is detached and is then mounted again on the support plate, cumbersome mounting and adjustment operations are necessary, and these operations, in most cases, cannot be left to the user but require the intervention of a service engineer.

EP-A-0 791 461 discloses an ink jet printer wherein four support points are formed by two pairs of recesses on opposite sides of the printhead, and two spherical surfaces are formed directly on the mounting plate so as to engage the recesses of the first pair, and two spherical surfaces are formed on a detachable clamping plate so as to engage in the recesses of the second pair. The clamping plate can be biased against the mounting plate and is positioned relative thereto by another sphere-and-recess-type support point.

SUMMARY OF THE INVENTION

The present invention provides a printer in which the printhead can easily be detached and remounted and can be stably and reproducibly positioned with high accuracy.

The second part of the elastic support has its spherical surface formed by a bead fixed on a liftable wire for detaching the printhead, said wire being elastically biased toward the recess so that the elastic support point releasably biases the printhead towards said first side of the printhead.

When a printhead is mounted, it is at first placed onto the two rigid support points, and then an elastic force is applied at the elastic support point. This releasable support point is formed by a recess in the body of the printhead and a spherical surface in the form of a bead that is fixed on a piece of wire. Since this support point will be located on the side of the printhead that is remote from the support surface, the necessary biasing force can simply be provided by means of tension springs which draw the wire towards the support plate.

The elastic force is transmitted through the body of the printhead and also causes the spherical surfaces at the two rigid support points to center themselves in their respective recesses. Thus, one simple operation is sufficient for adjusting the printhead exactly in the desired position and posture and fixing it in all six degrees of freedom. Moreover, since the frictional forces involved in the self-centering operations are extremely small, the exact positioning of the printhead is highly reproducible and reliable.

Since the operation of a printhead is frequently accompanied by the generation of heat, e.g. in a hot melt ink jet printer, in which the ink is solid at room temperature and must be heated to 100° C. or more in order to become liquid, the mounting structure for the printhead should allow for a certain amount of thermal expansion and contraction of the printhead. This can be achieved by arranging the two rigid support points on one of the longer sides of the printhead, in the vicinity of the ends thereof, and by using a conical shape of the recess only for one support point but an elongated recess, for example in the form of a V-shaped groove, for the other support point. Thus, the spherical surface engaging in the conical recess will fix the position of the printhead in all three translational degrees of freedom, and the engagement of the other spherical surface in the V-shaped groove will fix two rotational degrees of freedom, but will allow this spherical surface to slide in the groove in order to compensate for thermal expansion.

Since thermal expansion not only of the printheads but also of the support plate may present a serious problem, it is one of the advantages of the present invention that the limited mechanical contact between the spherical surfaces and their recesses at only three support points helps to thermally insulate the support plate from the printheads. The elastic support point, which, in the above construction, only has to fix the printhead in the remaining third rotational degree of freedom, may also include a groove-shaped recess.

If the wire extends in the direction normal to the axis of rotation that is defined by the two rigid support points, the angular position of the printhead (third rotational degree of freedom) can easily and precisely be controlled by adjusting the longitudinal position of the wire, since any possible bending of the wire will have no influence on the angular position of the printhead. This construction is particularly advantageous for a printer in which a plurality of printheads are arranged side-by-side on the support plate. Then, the elastic support point for all the printheads may be formed by a single wire on which the beads are arranged with well defined spacings. The angular position of all the printheads may thus be adjusted by simply adjusting the longitudinal position of the single wire. Likewise, the elastic support points for all the printheads may easily be released simply be lifting and removing the wire.

It is possible that the elastic support points and the wire are located in a central position of the printheads, so that both rigid support points of each printhead would be subject to essentially equal biasing forces. However, for simplifying the operation of replacing one or more printheads, it is preferable that the elastic support points and the wire are located near the end portion of the printheads, so that it is sufficient to move the wire only a short distance in order to be able to remove the printheads. Advantageously, an additional spring mechanism may be used for exerting a biasing force on the other ends of the printheads and on the corresponding rigid support points. However, it should be realized that this additional spring mechanism is not involved in positioning the printheads but only serves to make the engagement at the rigid support points more reliable. When the printheads are to be removed, the additional spring mechanism may be lifted and shifted aside, similarly as the wire described above. Preferably, the lift and shift movements of the wire and the additional spring mechanism are mechanically coupled to one another so that the replacement operation becomes particularly simple.

The spherical surfaces for all support points are preferably formed by metal balls which have a sufficient hardness and are readily available with exactly defined diameters and exact spherical surfaces, so that a high positioning accuracy may be achieved.

BRIEF DESCRIPTION OF THE DRAWINGS

A preferred embodiment of the present invention will now be described in conjunction with the following drawings, wherein.

DETAILED DESCRIPTION OF THE INVENTION

Figure 1:
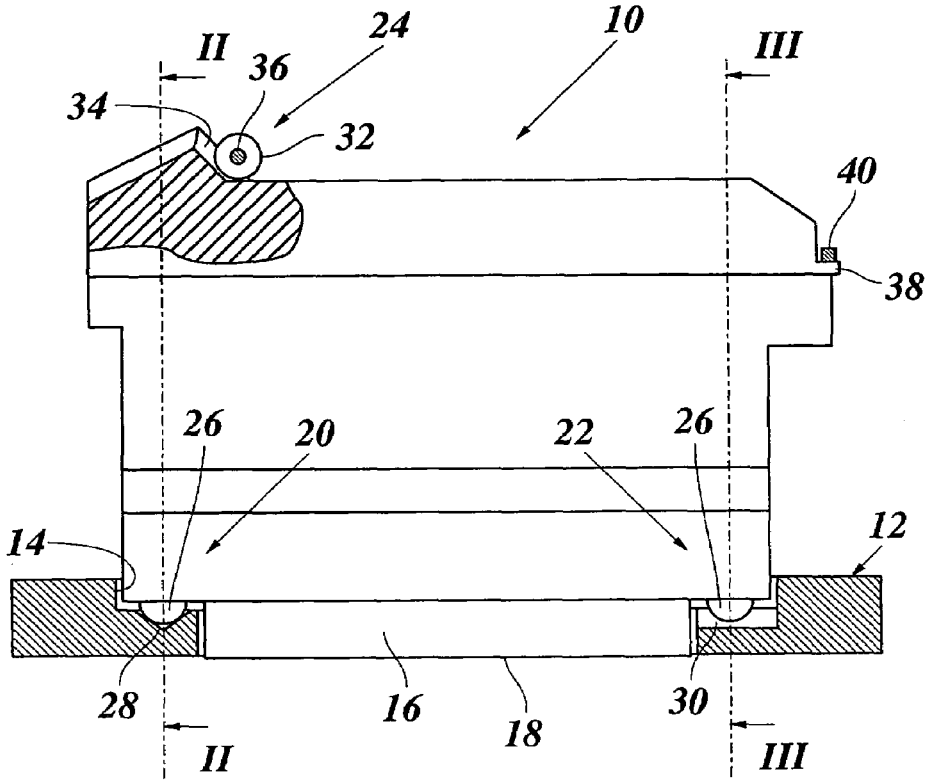
FIG. 1 is a side view, partially in section, of a printhead supported on a support plate.

In FIG. 1, a hot melt ink jet printhead 10 is mounted in an upright position on a metal support plate 12. The support plate 12 is attached to a carriage (not shown) of the printer, which reciprocates in a direction normal to the drawing in FIG. 1, so that the printhead 10 scans a recording medium that would be disposed right underneath the support plate. A lower portion of the printhead 10 is inserted with play in a recess 14 formed in the top surface of the support plate 12 and has a nozzle section 16 which projects through an opening of the support plate and forms a downwardly oriented nozzle face 18.

The support plate 12 is rigidly held by the carriage and is so adjusted that it is exactly parallel to the surface of the recording medium. The printhead 10 has to be positioned on the support plate 12 with high accuracy, so that its position in all three directions in space is well defined and known, the nozzle face 18 is also exactly parallel with the surface of the recording medium, and the lengthwise direction of the printhead (from left to right in FIG. 1) forms exactly a right angle with the direction of movement of the carriage. This is achieved by holding and positioning the printhead 10 on the support plate 12 at three support points 20, 22 and 24.

The two support points 20 and 22 rigidly support the printhead 10 on the bottom of the recess 14 and are located at opposite ends of the printhead. Each of the support points comprises a spherical surface that is formed by a metal ball 26 which is adapted to engage recesses 28, 30 of the support plate 12. The balls 26 are partially embedded in the body of the printhead 10 which may, for example, be made of carbon, and the extent to which the balls project from the printhead is adjusted with high accuracy. The recess 28 has the shape of an upwardly open cone that has been precisely machined in the support plate 14. Thus, when the ball 26 is slightly pressed into the recess 28, it will automatically be centered on the center of the recess and will then be fixed in all three directions in space.

Figure 2:
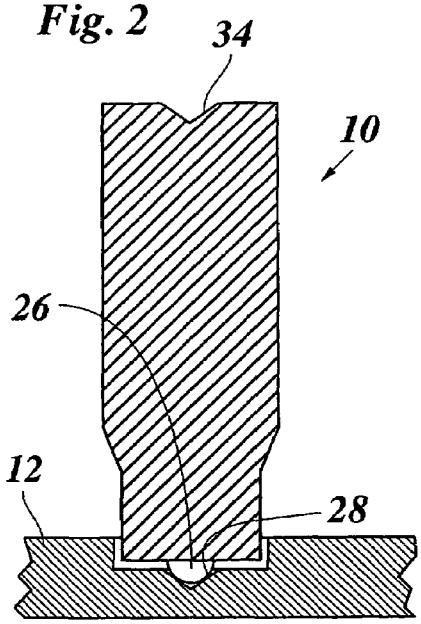
FIG. 2 is a section taken along line II-II in FIG. 1.
Figure 3:
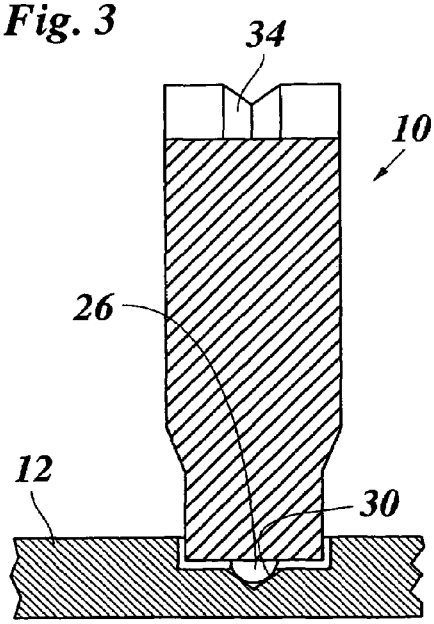
FIG. 3 is a section taken along line III-III in FIG. 1.

In contrast, the recess 30 of the support point 22 is a V-shaped groove which extends in longitudinal direction of the printhead. The cross-sections of the recesses 28 and 30, in the plane normal to the lengthwise direction of the printhead, are visible in FIGS. 2 and 3, respectively.

Thus, the support point 22 prevents the printhead 10 from rotating about a vertical axis passing through the support point 20, and also from rotating about an axis passing through the support point 20 and being normal to the plane of the drawing in FIG. 1. The support point 22 permits, however, a slight thermal expansion or contraction of the printhead in its lengthwise direction.

The third support point 24 is located on the top side of the printhead 10 approximately above the support point 20 and is formed by a ball 32 engaging in a recess 34. The bead or ball 32 is fixed on a wire 36 which is shown in cross-section in FIG. 1. The recess 34 is a V-shaped groove which extends in longitudinal direction of the printhead and passes over a roof-shaped structure on the top side of the printhead. Thus, the support point 24 prevents the printhead 10 from tilting about an axis that is defined by the two rigid support points 20 and 22.

As is further shown in FIG. 1, the top portion of the printhead 10 forms a ledge 38 at the end opposite to that of the recess 34, and a wire 40, shown in cross-section, rests on this ledge. As will be described below, the wires 36 and 40 are spring-biased downwardly, so that the bead 32 is forced into the recess 34 and is centered therein, and the balls 26 are forced into the recesses 28 and 30. The wire 40 does in no way define the position of the printhead and only serves to supplement the biasing force of the wire 36 and to prevent the ball of the support point 22 from upwardly escaping from the recess 30.

Figure 4:
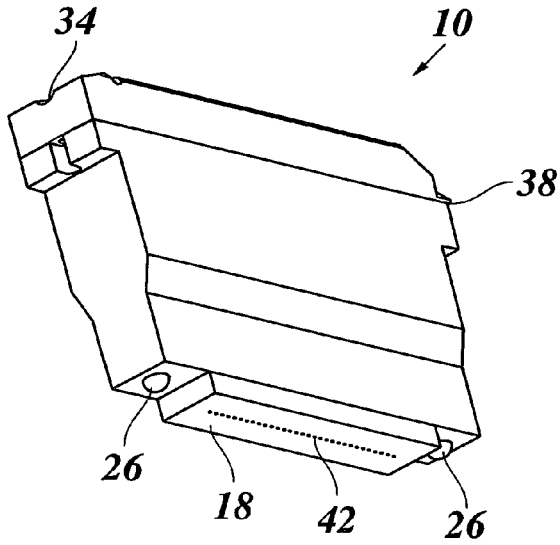
FIG. 4 is a perspective view of the printhead.

FIG. 4 is a perspective view of the printhead 10 and shows a linear array of nozzles 42 in the nozzle face 18.

Figure 5:
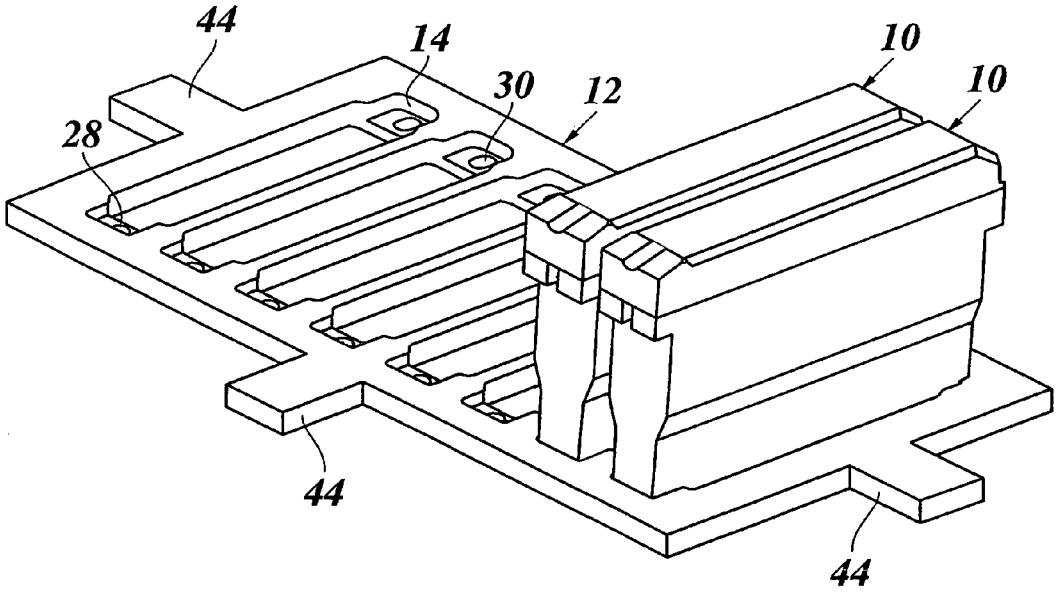
FIG. 5 is a perspective view of the support plate with mounting positions for eight printheads, with two printheads being inserted.

In FIG. 5, two printheads 10 are shown in their position on the support plate 12, which has recesses 14 for six further printheads. The support plate 12 has lugs 44 for attachment at the carriage.

Figure 6:
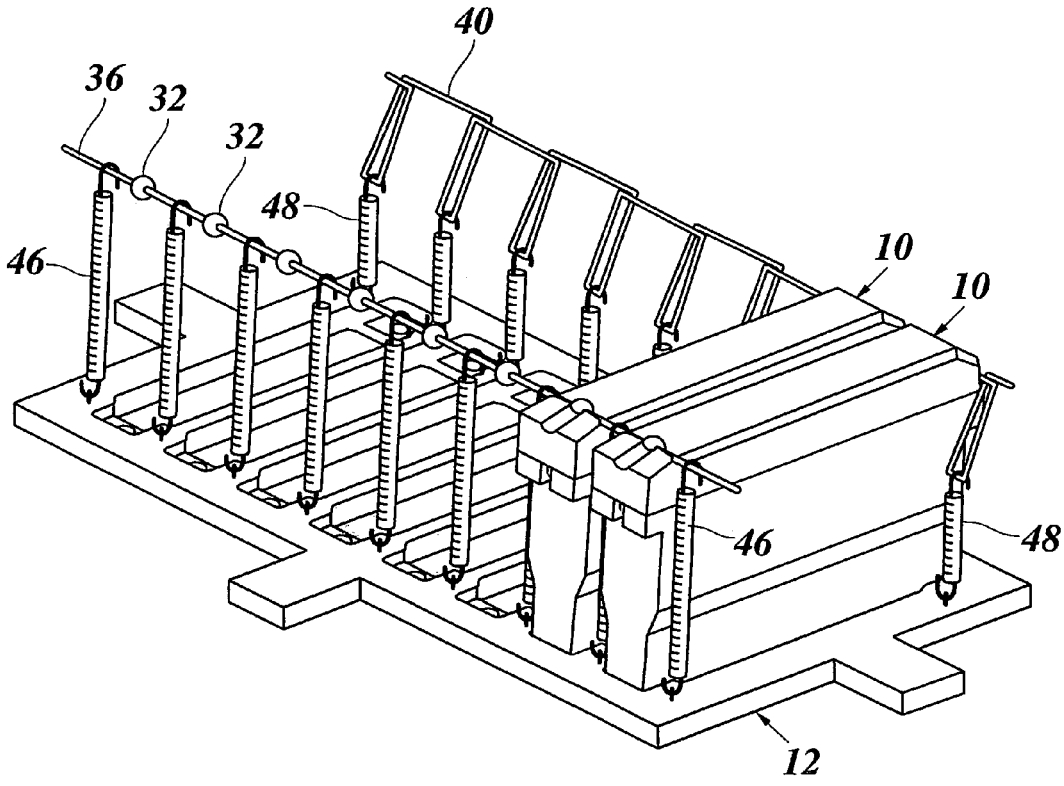
FIG. 6 shows the support plate and the printheads of FIG. 5 as well as spring mechanisms for biasing the printheads against the support plate.

As is shown in FIG. 6, the wire 36 extends over all the mounting positions for the printheads 10 and carries a bead 32 for each printhead. The spacings between the balls 32 correspond exactly to the spacing between the printheads 10. A number of tension springs 46 are anchored at the wire 36 in the intervals between the balls 32 and bias the wire 36 towards the support plate 12. Thanks to the distribution of the tension springs 46, the biasing force is evenly distributed over the length of the wire 36. The tension springs are anchored at the support plate 12 at positions laterally offset from the vertical projection of the wire 36, so that the springs are slightly inclined and urge the wire 36 and the beads 32 against the slopes of the roof structures of the printheads 10. These roof structures prevent the wire from slipping off from the printheads. The wire 40 at the other end of the printheads forms a number of regularly spaced loops in which tension springs 48 are anchored which bias the wire 40 towards the support plate 12.

When the printheads 10 are to be removed from the support plate, the wires 36 and 40 are lifted against the forces of the tension springs and are moved aside. A useful mechanism for this will now be explained in conjunction with FIGS. 7 and 8.

Figure 7:
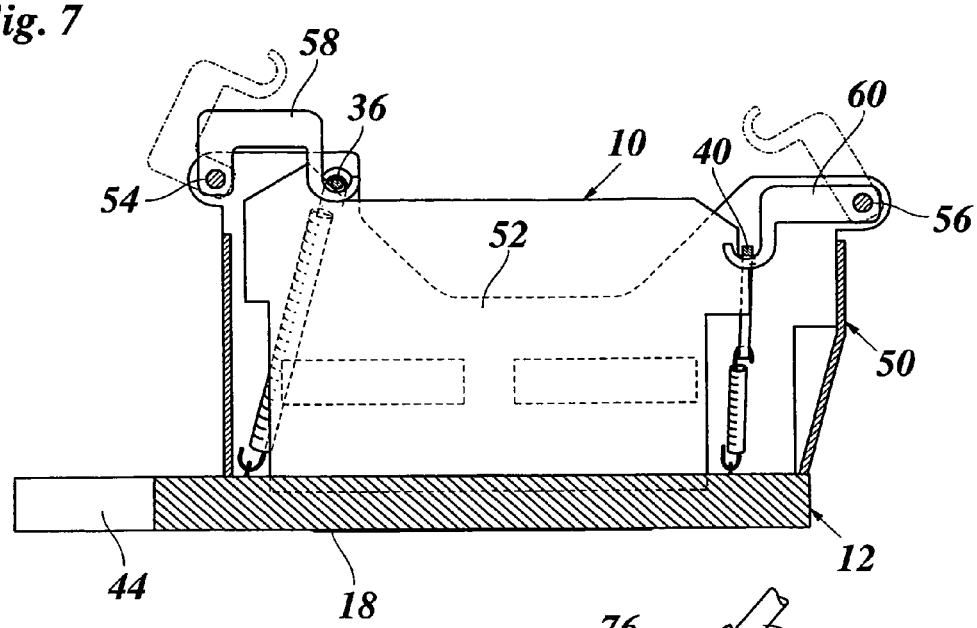
FIGS. 7 and 8 show a release mechanism for the spring mechanisms.

As is shown in FIG. 7, the whole assembly of printheads 10 is accommodated in a case-like frame 50 which is mounted on the support plate 12 and has end walls 52 supporting the opposite ends of the wires 36 and 40. In this way, the position of the wires in their longitudinal direction is precisely defined. Outwardly projecting top portions of the end walls 52 serve for rotatably supporting two shafts 54, 56 which each carry a set of hooks 58, 60. In the positions shown in continuous lines in FIG. 7, the hooks 58, 60, which are located in the gaps between the adjacent printheads 10, are positioned slightly below the wires 36, 40 without contacting them. Thus, the hooks are inoperative in this position. By rotating the shafts 54, 56, the hooks 58, 60 may be pivoted into the positions shown in phantom lines, thereby lifting the wires 36, 40 and moving them outwardly, so that the printheads 10 can be withdrawn out of the recesses of the support plate 12.

Figure 8:
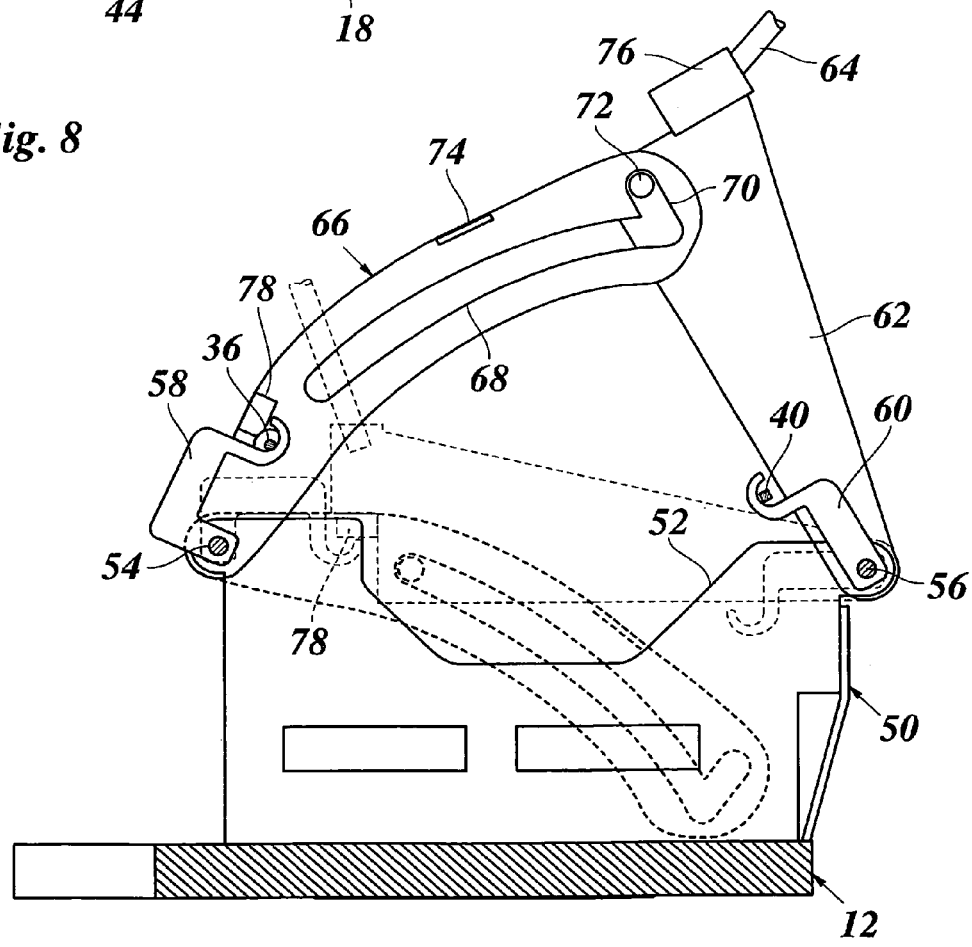

In FIG. 8, the inoperative position of the hooks 58, 60 is shown in phantom lines, and the continuous lines show the lifted position of the hooks and the wires. The opposite ends of the shaft 56 each carry a lever 62 having a handle 64 which may be gripped for pivoting the lever and hence the hooks 60. The levers 62 are arranged adjacent to and in parallel with the end walls 52 of the frame 50. Similarly, the shaft 54 carries two arcuate levers 66 for pivoting the hooks 58. The levers 66 have an arcuate slot 68 with an upwardly angled end portion 70. A pin 72 projects from the lever 62 and into the slot 68. When the hooks 58, 60 are in the inoperative position, the levers 62 and 66 have the position shown in phantom lines in FIG. 8. The pin 72 is then located at the left end of the arcuate slot 68.

When the user wants to detach one or more printheads, he grips the handle 64 and tilts the lever 62 into the position shown by the continuous lines in FIG. 8. The pin 72 pushes the lever 66 upwardly, thereby tilting the hooks 58, and, finally, the pin 72 will be positioned in the angled portion 70 of the slot, so that the assembly is arrested in an open position permitting the removal of the printheads. The handle 64 is a bow which connects the two levers 62 and is so arranged that it permits easy access to the printheads. It will be understood that the tension springs 46 and 48 (FIG. 6) are expanded when the hooks are lifted, and hold the wires 36 and 40 in engagement in the hooks.

When the printheads have been exchanged and are to be positioned and secured again, the levers 66 are manually drawn upwardly so that the pin 72 will enter into the arcuate slot 68. For this purpose, the levers 66 are provided with outwardly projecting tabs 74. The pin 72 being at the right end of the arcuate portion of the slot 68, the levers 62 may be tilted back into the position shown in phantom lines, and the levers 66 will be gently returned into their lowered position while the pin 72 moves to the right end of the slot 68. By the end of this movement, the wires 36, 40 will again be placed on top of the printheads and on the ledges 38, respectively, and the biasing forces of the springs will act upon the balls 32 and on the printheads, so that the balls 32, 26 are centered in their positions in the recesses 34, 28 and 30. The design of the levers 62, 66 and the dimensions of the springs 46, 48 are such that, at first, the springs 46 will bias the wire 36, so that the printheads will be positioned by the action of the three support points without being subject to any substantial frictional forces. Only then will the wire 40 engage the ledge 38 to secure the printheads in their position.

When the lever 62 reaches its lower end position, a fixture 76 provided at the free end of this lever will come to rest upon a co-operating fixture 78 on the lever 66, and a stop (not shown) provided on the end walls 52 will terminate the pivotal movement of the levers. With the fixtures 76, 78, the levers may then be locked to each other so that the whole assembly will be stably held in a position where the printheads are ready to operate.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

The invention claimed is:

1. A printer comprising a printhead and a support plate, said printhead being detachably mounted on the support plate and held thereon at two rigid support points located on a first side of the printhead and one elastic support point located on a second side of the printhead opposite to said first side, each of the support points being defined by a first portion on the side of the printhead and a second portion on the side of the support plate, and one of the first and second portions is a spherical surface engaged in a recess of the other of the first and second portions in a self-centering manner, wherein the second part of the elastic support point has its spherical surface formed by a bead fixed on a liftable wire permitting detaching the printhead, said wire being elastically biased toward the recess so that the elastic support point releasably biases the printhead towards said first side of the printhead.

2. The printer according to claim 1, wherein the printhead is fixed in six degrees of freedom by the three support points.

3. The printer according to claim 1, wherein a first one of the rigid support points has a conical recess which defines the position of the corresponding spherical surface in all three directions in space.

4. The printer according to claim 3, wherein the other rigid support point has a V-shaped recess which defines the position of the corresponding spherical surface in two directions in space and has its longitudinal axis arranged radially in relation to the first support point.

5. The printer according to claim 1, wherein the printhead has an elongated body and the two rigid support points are located at opposite ends of that body.

6. The printer according to claim 1, wherein the spherical surfaces of the rigid support points are formed on the printhead and the corresponding recesses are formed in the support plate.

7. The printer according to claim 1, wherein the elastic support point has a recess in the form of V-shaped grove which, through engagement with the spherical surface, secures the printhead against pivotal movement about an axis defined by the two rigid support points.

8. The printer according to claim 7, wherein the wire extends in a direction orthogonal to the pivotal axis defined by the two rigid support points.

9. The printer according to claim 1, wherein a plurality of printheads are mounted on the support plate, and the elastic support points for said plurality of printheads are formed by a plurality of beads fixed on said wire.

10. The printer according to claim 1, wherein the printhead or printheads have an elongated body and the elastic support points are located near one end of the body.

11. The printer according to claim 1, wherein tension springs are anchored with one end at the support plate and with the other end at the wire for biasing the wire towards the support plate.

12. The printer according to claim 11, further comprising a lift mechanism for lifting the wire away from the support plate against the bias force of the tension springs and moving the wire outwardly into a position which permits withdrawal of the printheads from the support plate.

13. The printer according to claim 11, further comprising a spring mechanism arranged to bias the ends of the printheads opposite to the ends having the elastic support points, towards the support plate.

14. The printer according to claim 13, wherein the spring mechanism comprises a wire resting on the printheads and tension springs connecting the wire to the support plate.

15. The printer according to claim 14, wherein the spring mechanism further comprises a lift mechanism for lifting the wire away from the support plate against the force of the tension springs and moving the wire outwardly into a position permitting the withdrawal of the printheads.

16. The printer according to claim 15, wherein the lift mechanism comprises hooks disposed along the wire and mounted on a shaft so as to grip and lift the wire by being pivoted about the axis of said shaft.

17. The printer according to claim 15, wherein the lift mechanism includes levers connected to a shaft, said levers being in sliding engagement with one another so that the pivotal movement of one lever will induce the pivotal movement of the other lever.

* * * * *